US005123683A

United States Patent [19]

Solovieff

[11] Patent Number: 5,123,683

[45] Date of Patent: Jun. 23, 1992

[54] HANDLESET WITH ADJUSTABLE LATCH RETRACTING MECHANISM

[75] Inventor: Paul G. Solovieff, Tustin, Calif.

[73] Assignee: Emhart Inc., Newark, Del.

[21] Appl. No.: 632,763

[22] Filed: Dec. 21, 1990

[51] Int. Cl.[5] ..... E05C 1/16

[52] U.S. Cl. ..... 292/172; 292/DIG. 60; 292/1

[58] Field of Search ..... 292/142, 172, 169.23, 292/199, 1, DIG. 60

[56] References Cited

U.S. PATENT DOCUMENTS 4,052,092 10/1977 Bergen ..... 292/142 R
4,687,239 8/1987 Lin ..... 292/DIG. 60 X

*Primary Examiner*—Richard E. Moore

*Attorney, Agent, or Firm*—J. Bruce Hoofnagle

[57] ABSTRACT

A single handleset 10 with an adjustable retracting mechanism 11 includes a handle 20 and thumbpiece 32 which operates a rack 48. A pinion 70 is in mesh engagement with rack 48 at all times. A spindle 84 is connectable to pinion 70 in either of two positions determined by the righthand or lefthand orientation of a door 18 to which assembly 10 is mounted. Spindle 84 is adjustable without decoupling pinion 70 from rack 48 to insure proper orientation of the spindle relative to the pinion for effective operation of a latchbolt assembly 140.

A double handleset 210 with the adjustable latch retracting mechanism 11 includes a pair of handle units 212 and 234 and also provides the versatility of adjusting spindle 84 independently of pinions 70 to accommodate either a righthand or lefthand orientation.

14 Claims, 3 Drawing Sheets

HANDLESET WITH ADJUSTABLE LATCH RETRACTING MECHANISM

BACKGROUND OF THE INVENTION

This invention relates to a handleset with an adjustable latch retracting mechanism for use with a left hand or a right hand door and particularly relates to a handleset which includes facility for readily converting a latchbolt driving mechanism of the handleset for use with either a left hand or a right hand door.

When mounting a door in a door frame opening, the door can be hinged either on the left vertical side or the right vertical side as viewed from the outside or exterior of the door. Any door which is hinged on the left side, as viewed from the outside, is referred to as a left hand door. Any door which is hinged on the right side, as viewed from the outside, is referred to as a right hand door.

With respect to a left hand door, the latchbolt of the associated latchbolt assembly will extend to the right of the door from the right side, as viewed from the outside. In a right hand door, the latchbolt will extend to the left of the door from the left side, as viewed from the outside.

Typically, the security features of the handleset, such as a keyed lock, are located for accessibility from the outside so that the handleset requires key operation to facilitate opening of the door from the outside. Thus, the keyed lock must be accessible from the outside regardless of whether the handleset is adjusted for operation with a left hand door or a right hand door. It is clear then that, while the keyed lock will remain accessible from the outside regardless of the hand of the door, the direction of travel of the latchbolt must be reversed by one hundred and eighty degrees when adjusting the handleset from a left hand orientation to a right hand orientation and vice-versa.

In latch retracting systems which include the adjustment feature, the latch retracting mechanism includes a rack which is moved linearly by operation of a door operator such as, for example, a thumbpiece of a handleset. A pinion is located in engagement with the rack and is attached to a half round spindle at one end thereof. The other end of the spindle is positioned to engage cam surfaces of a retractor which is coupled to the trailing end of the latch bolt.

In operation, the thumbpiece is operated to move the rack linearly whereby the pinion and half round spindle are rotated. As the spindle rotates, the cam surfaces are engaged thereby to move the retractor. This results in retraction of the latchbolt to permit opening of the door.

If the hand orientation of the handleset is to be reversed, the latchbolt is rotated through an arc of one hundred and eighty degrees as noted above. In order to maintain the proper orientation of the half round spindle to effect retraction movement of the latchbolt, the spindle must also be rotated about its axis by one hundred and eighty degrees. Of course, the rack does not have to be repositioned.

In currently available latch retracting systems which include a hand orientation adjustment feature, the half round spindle is attached to the pinion. When adjustment is made, the spindle is retracted away from the rack for rotation independently thereof. Since the pinion is attached to the spindle, the pinion also disengages from the rack and is rotated one hundred and eighty degrees with the spindle and is then reengaged with the rack. A system of this type is disclosed in U.S. Pat. No. 4,052,092 which issued on Oct. 4, 1977.

Occasionally during the adjustment process, the spindle may not be rotated precisely one hundred and eighty degrees when the pinion is returned to engagement with the rack. In this instance, the spindle does not engage the retractor in the proper relationship to facilitate full retraction of the latchbolt upon operation of the thumbpiece. Thus, the handleset does not function effectively.

Thus, there is a need for a handleset with a hand orientation adjustment capability which will insure placement of the component parts to effect proper operation of the latchbolt retraction mechanism.

In some latch assembly systems, a handleset is used on both sides of the door. In such instances, it would be desirable to provide facility for moving the latchbolt by operation of either thumbpiece while providing for adjustment of the hand orientation of the associated latch assembly.

Thus, there is a need for a double handleset latch assembly which allows for adjustment of the hand orientation of the assembly.

SUMMARY OF THE INVENTION

It is, therefore, an object of this invention to provide a handleset with an adjustable latch retracting mechanism which is adjustable to permit use of the mechanism with a door in a left hand or a right hand orientation.

It is a further object of this invention to provide a handleset with an adjustable latch retracting mechanism which is mountable with a door and includes operators on each side of the door and which permits the adjustment of the mechanism for use with the door in a left hand or a right hand orientation.

An additional object of this invention is to provide a handleset with an adjustable latch retracting mechanism which is adjustable for use with a door in a left hand or a right hand orientation while insuring that the retracting mechanism is located in the appropriate relationship to a latchbolt to provide for effective operation thereof.

With these and other objects in mind, the present invention contemplates a handleset with an adjustable latch retracting which includes a latchbolt and moving means attached thereto to facilitate movement of the latchbolt. An operator is coupled to a rack which is in engagement with a pinion. A half round spindle has one end thereof attachable to the pinion and an opposite end thereof engageable with the moving means. A retracting means is provided for allowing withdrawal of the half round spindle from engagement with the pinion to permit rotational movement of the spindle independently of the pinion to adjust the orientation of the spindle relative to the pinion.

Other objects, features and advantages of the present invention will become more fully apparent from the following detailed description of the preferred embodiments, the appended claims and the accompanying drawings.

DETAILED DESCRIPTION OF THE PREFERRED EMBODIMENTS

Figures 1, 9:
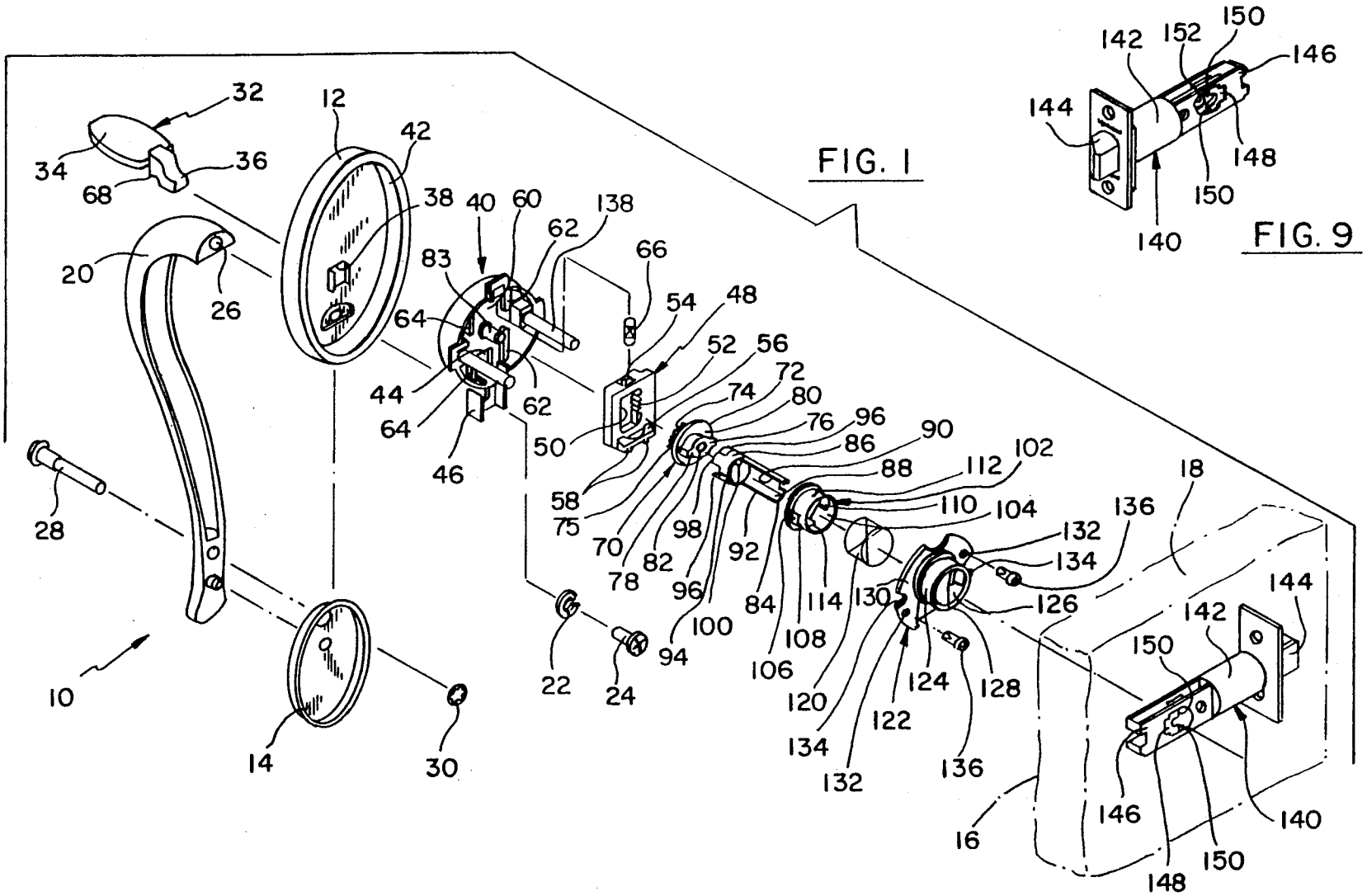
FIG. 1 is an exploded perspective view showing a single handleset with an adjustable latch retracting mechanism embodying certain principles of the invention.
FIG. 9 is a perspective view of a latchbolt assembly.

Referring to FIG. 1, a single handleset 10 with an adjustable latch retracting mechanism 11, which illustrates a preferred embodiment of the invention, includes a top rose 12 and a bottom rose 14 mounted on the outside or exterior surface 16 of a door 18. A handle 20 is assembled at an upper end thereof with the top rose 12 by use of a lock washer 22 and screw 24 in a threaded hole 26 of the handle. A bottom end of the handle 20 is assembled with the bottom rose 14 by use of a headed shank type fastener 28 and a retaining ring 30. A thumbpiece 32, which functions as the operator for the latch handleset 10, includes a thumb-engageable paddle 34 and an actuator element 36 which is inserted through an opening 38 in the top rose 12.

A rose insert 40 is located within a shell-like inner opening 42 of top rose 12 and is formed with an opening 44 which is aligned with top rose opening 38. A tab 46 extends below and is formed integrally with insert 40 and is formed with an opening which facilitates attachment of the insert with top rose 12 by use of the lock washer 22 and screw 24.

A rack 48 is generally rectangular in shape with a central opening 50 formed therethrough. Rack teeth 52 are formed along at least one vertical side wall of opening 50. A finger 54 extends upwardly from an upper surface of rack 48 while an actuator foot 56 extends rearwardly from the bottom of an inner face of the rack. A pair of spaced, parallel guide rails 58 extends downwardly from the actuator foot 56.

In assembly, rack 48 is positioned for vertical movement within a nest 60 of insert 40 formed by and between spaced sets of rails 62 and 64. A lower end of a compression spring 66 is positioned over finger 54 of rack 48 and an upper end of the spring is located against the upper wall of nest 60 to normally urge the rack downwardly within the nest. Actuator element 36 is located through opening 38 of top rose 12 and opening 44 of insert 40, beneath actuator foot 56 and between rails 58. As thumbpiece 32 is operated by depression of thumb paddle 34, the thumbpiece is pivoted about a pivot foot 68 on the underside of actuator element 36 to pivot the element upwardly against the underside of rack 48. This causes rack 48 to be raised against the biasing action of spring 66. Also, pivot foot 68 extends downwardly from the plane of paddle 34 and serves to facilitate retention of thumbpiece 32 with top rose 12 and insert 40.

A pinion 70 includes a disc-like central body 72 which has pinion teeth 74 formed with and extending from a forward surface 75 thereof. A pair of spaced lugs 76 and 78 are formed with and extend from a rearward surface 80 of the body 72. An axial hole 82 is formed through pinion 70 with lugs 76 and 78 extending from opposite sides of the hole in a one hundred and eighty degrees orientation. Pinion 70 is positioned so that hole 82 is located on a post 83 which extends from nest 60 of insert 40. In this position, teeth 74 of pinion 70 extend into meshing engagement with teeth 52 of rack 48 so that, upon actuated movement of the rack, the pinion is rotated.

A half round spindle 84 includes a cylindrical shell portion 86 with a half round trough-like portion 88 extending rearwardly from the shell portion and forms edge surfaces 90 and 92 which are one hundred and eighty degrees apart.

Figure 2:
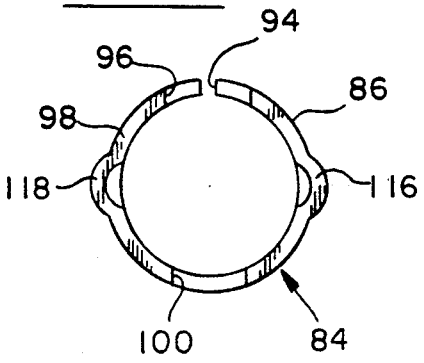
FIG. 2 is an end view of a half round spindle which forms a portion of the handleset with the adjustable latch retracting mechanism of FIG. 1 in accordance with certain principles of the invention.
Figure 3:
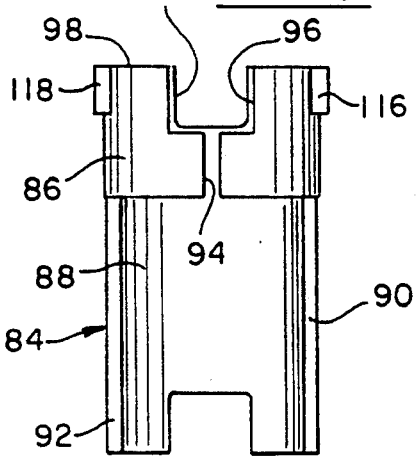
FIG. 3 is a side view of the half round spindle of FIG. 2 further illustrating certain principles of the invention.

Referring to FIGS. 1, 2 and 3, shell portion 86 is formed with a through slot 94 and a clearance notch 96 which straddles the through slot from an outer end 98 of the shell portion. A drive notch 100 is formed in the outer end 98 of shell portion 86 directly opposite clearance notch 96 and is slightly narrower than the clearance notch as clearly viewed in FIG. 3.

Outer end 98 of spindle 84 is placed in engagement with rearward surface 80 of pinion 70 with clearance notch 96 located loosely about lug 78 and drive notch 100 is located snugly about lug 76. In this position, when pinion 70 is rotated, lug 76 causes spindle 84 to rotate through a drive connection with drive notch 100. The loose fit of notch 96 about lug 78 permits the major drive connection between pinion 70 and spindle to be effected through drive notch 100.

Figure 4:
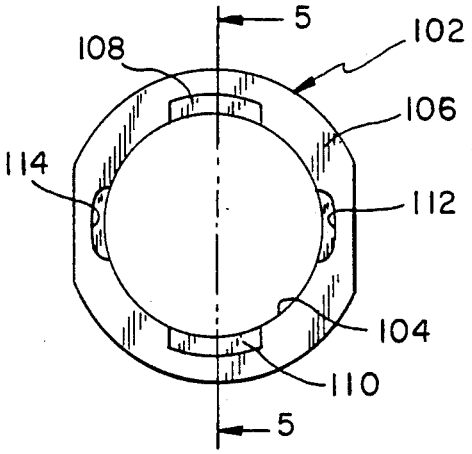
FIG. 4 is an end view of an eyelet which forms a portion of the handleset with the adjustable latch retracting mechanism in accordance with certain principles of the invention.
Figure 5:
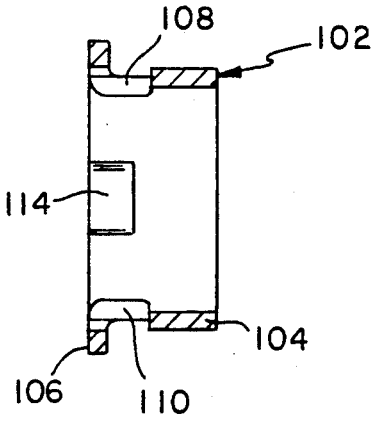
FIG. 5 is a sectional view taken along line 5—5 of FIG. 4 showing additional features of the eyelet of FIG. 4 in accordance with certain principles of the invention.

Referring to FIGS. 1, 4 and 5, an eyelet 102 is formed as a cylindrical shell 104 with a flange 106 formed at one end thereof. A pair of oppositely spaced slots 108 and 110 are formed in the shell 104 adjacent flange 106 and a pair of oppositely spaced pockets 112 and 114 are formed in the inner wall of the shell. A cylindrical opening of shell 104 is of sufficient size to slide over half round portion 88 and shell portion 86 of half round spindle 84 with slots 108 and 110 for receiving lugs 76 and 78 of pinion 70. Also, pockets 112 and 114 of eyelet 102 fit snugly over projecting ears 116 and 118, respectively, formed radially outwardly from shell 86 of spindle 84 to retain the eyelet with the spindle.

Referring again to FIG. 1, a compression spring 120 is positioned over eyelet 102 and rests against the inner surface of flange 106. An index plate 122 is formed with a cylindrical hub 124 having a central opening 126 with a closing lip 128. A flange 130 is formed at one end of hub 124 and is formed with a pair of spaced holes 132 and a pair of spaced slots 134. The opening 126 of hub 124 is placed over spring 120, eyelet 102 and spindle 84. Flange 130 is then secured to insert 40 by placement of a pair of screws 136 through holes 132 and into threaded holes formed in the insert. Also, a pair of mounting posts 138, which extend from insert 40, are located within slots 134 to facilitate location of index plate 122 in assembly with the insert.

With this assembly, half round portion 88 of spindle 84 extends rearwardly through and from index plate 122.

A latchbolt assembly 140 includes a casing 142 which contains a latchbolt 144 extending from one end thereof in a latched position and which can be retracted within the casing in an unlatched position. A frame 146 is attached to a rearward end of casing 142 and provides an enclosure for a retractor 148 which is coupled to a rearward portion of latchbolt 144. Retractor 148 is formed with a pair of cam surfaces 150 which are visible through a half round opening 152 formed in frame 146.

Half round portion 88 of spindle 84 is positioned through half round opening 152 of frame 146 and is positioned so that edge surfaces 90 and 92 of the half round portion are positioned to engage cam surfaces 150 upon rotation of spindle 84. In this manner, when thumbpiece 32 is depressed, retractor 148 is moved rearwardly within frame 146 to withdraw latchbolt 144 to its unlatched position within casing 142.

Thus, half round portion 88 of spindle 84 must always maintain the above-described relationship with retractor 148 to effect movement of latchbolt 144 upon operation of thumbpiece 32.

In the orientation of spindle 84 as illustrated in FIG. 1, half round portion 88 is positioned to function with the latchbolt assembly 140 assembled in door 18 for a right hand orientation. Indicia on flange 130 of index plate 122, in the form of an inverted "C" and the letters "RH," provides indication to an installer of the required position of spindle 84 for a right hand door.

If an installer purchases a handleset, such as handleset 10, the adjustable latch retracting mechanism 11 permits the installer to adjust the handleset for the hand orientation of the door. This provides versatility in handleset 10 and allows for the manufacture of a single adjustable design as compared with a first design dedicated to a righthand door and a second design dedicated to a lefthand door.

If an installer has purchased a handleset, such as latch assembly 10, and spindle 84 is preassembled as illustrated in FIG. 1 in the righthand orientation but the assembly is to be installed with a lefthand door with the latchbolt assembly 140 as shown in FIG. 9, adjustment by use of the adjustable latch retracting mechanism 11 must be made. To effect the adjustment, half round portion 88 is gripped and pulled outwardly from index plate 122 until shell portion 86 clears lugs 76 and 78. In this adjustment process, pinion 70 remains mounted on post 83 and teeth 74 of the pinion remain enmeshed with teeth 52 of rack 48.

Spindle 84 is then rotated one hundred and eighty degrees until drive notch 100 is aligned with lug 78. Spindle 84 is then released and, under the biasing action of spring 120, is again positioned in engagement with pinion 70. Half round portion 88 now extends from index plate 122 in a "C" configuration for a lefthand orientation as indicated by the indicia on flange 130 of the index plate.

In the adjustable assembly as illustrated and disclosed in U.S. Pat. No. 4,052,092, the pinion is attached to the half round spindle and is withdrawn from engagement with the rack during the adjustment process. It is possible to rotate the spindle to a position other than a position one hundred and eighty degrees from the start position. Under this circumstance, when the pinion is returned to mesh engagement with the rack, the half round spindle is not in the precise position to effect proper movement of the latchbolt when the thumbpiece is depressed. Thus, it is possible that the latchbolt cannot be fully withdrawn to the unlatched position.

Handleset 10, as illustrated in FIG. 1, provides facility for maintaining pinion 70 in meshed engagement with rack 48 at all times, including the period when, by use of the adjustable latch retracting mechanism 11, spindle 84 is being adjusted to change the hand orientation of the handleset. In particular, drive notch 100 of spindle 84 can only be positioned over lug 76 or lug 78 which are one hundred and eighty degrees apart. Thus, spindle 84 will always be in the proper position for either a lefthand or a right orientation and thereby provide for proper and effective operation of the latchbolt 144.

Figure 6:
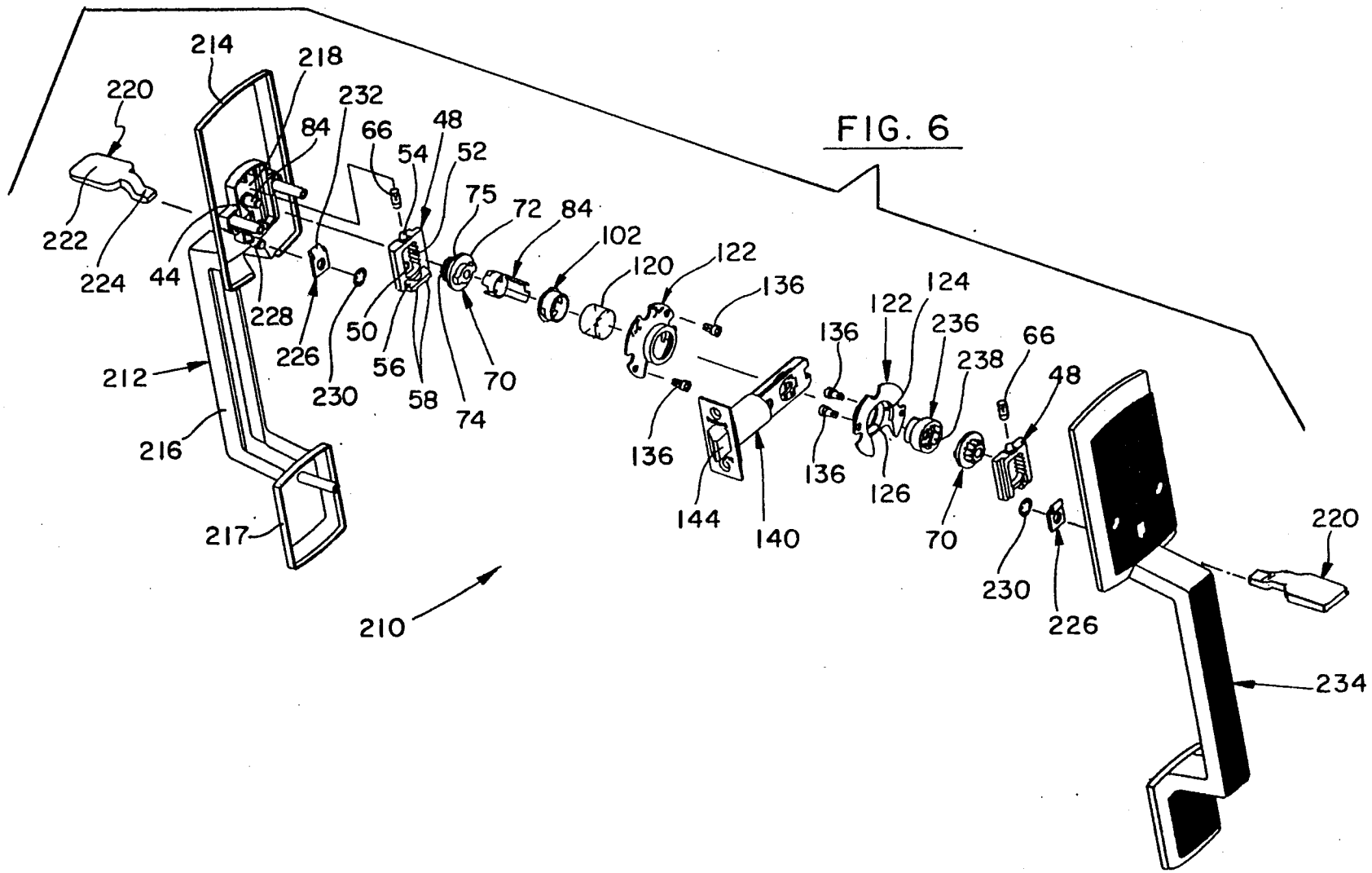
FIG. 6 is an exploded perspective view showing a double handleset with an adjustable latch retracting mechanism embodying certain principles of the invention.

Referring to FIG. 6, a double handleset 210 with the adjustable latch retracting mechanism 11 is illustrated and includes an arrangement of elements to the left of latchbolt assembly 140 which, in some instances, are identical to the elements of handleset 10 of FIG. 1. Thus, in the following description, only those elements which differ in some way will be described in detail. Otherwise, the elements common to handlesets 10 and 210 will be numbered as they appear in FIG. 1.

Handleset 210 includes a handle unit 212 having top rose 214, a handle 216 and a bottom rose 217 formed as an integral unit. The inner shell portion of top rose 214 is formed with structure similar to insert 40 (FIG. 1) and includes a nest 218 for receiving rack 48 in the same manner described above with respect to latch assembly 10. A thumbpiece 220 is formed with a paddle 222 and an actuator element 224. Note that thumbpiece 220 does not have a pivot foot such as pivot foot 68 (FIG. 1) of thumbpiece 32. Instead, a thumbpiece retainer 226 is mounted on a post 228 which extends from the inner shell portion of top rose 214 and is held in place on the post by retaining ring 230. Retainer 226 is formed with a tab 232 which is located under thumbpiece 220 between paddle 222 and element 224 to facilitate retention of the thumbpiece with the top rose 214. In this position, actuator element 224 is located beneath rack 48 and between rails 58 to facilitate movement of the rack when thumbpiece 220 is depressed.

Another handle unit 234 is identical to handle unit 212 and will not be described further.

The half round portion 88 of spindle 84 of handleset 210 is of sufficient length to extend through latchbolt assembly 140 and into opening 126 of index plate 122 which is located between the latchbolt assembly and handleset unit 234.

Figure 7:
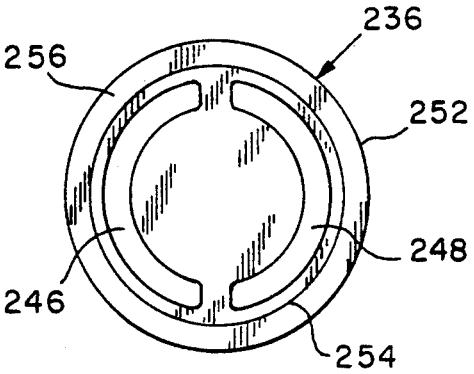
FIG. 7 is an end view of a pinion extension of the handleset with an adjustable latch retracting mechanism of FIG. 6 in accordance with certain principles of the invention.
Figure 8:
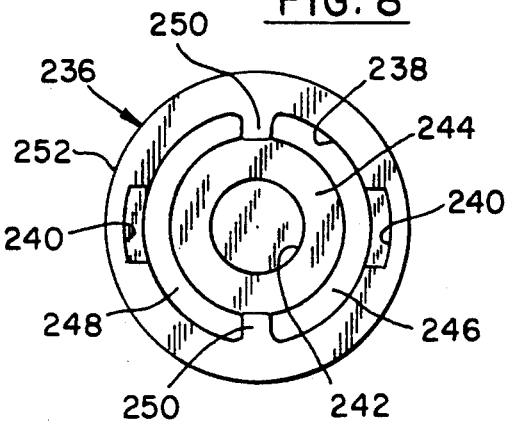
FIG. 8 is an end view of the pinion extension of FIG. 7 showing the end thereof opposite the end illustrated in FIG. 7 in accordance certain principles of the invention.

A pinion extension 236 is associated with handleset unit 234 and provides facility for coupling half round portion 88 to pinion 70 of unit 234 so that, upon operation of thumbpiece 220 of the unit, the half round portion is rotated to move latchbolt 144 as desired. Referring to FIGS. 6, 7 and 8, pinion extension 236 is formed with a cup-shaped opening 238 in one end thereof with a pair of spaced grooves 240 formed one hundred and eighty degrees apart in an inner wall of the opening. Also, an axial depression 242 is formed in a floor 244 of opening 238. A pair of interfacing "C" shaped slots 246 and 248 are also formed through floor 244. A pair of opposed ribs 250 are formed in and extend from the inner wall of opening 238. As viewed in FIG. 7, the exterior of pinion extension 236 is formed with a cylindrical-like exterior 252 which surrounds opening 238 and is further formed with an annular hub 254 of reduced diameter which forms a ledge 256 between the exterior and the hub.

Pinion extension 236 is assembled with pinion 70 whereby grooves 240 are positioned over lugs 76 and 78 of the pinion so that the extension will rotate upon rotation of the pinion. The free end of half round portion 88 of spindle 84 extends into either slot 246 or slot 248 of pinion extension 236 depending on the hand orientation of the door with which double handleset 210 is assembled. Thus, when thumbpiece 220 of handle unit 234 is depressed, pinion extension 236 is rotated whereby spindle 84 is rotated to move latchbolt 144 accordingly. In addition, when adjustment of handleset 210 is required to accommodate a different door hand orientation, pinion extension 236 remains in assembly with its associated pinion 70 and half round portion 88 is moved from one of the slots 246 or 248 to the other slot. This adjustment process is accomplished without the necessity for separating pinion 70 from mesh engagement with rack 48 associated with handle unit 234.

The above-described embodiments, of course, are not to be construed as limiting the breadth of the present invention. Modifications, and other alternative constructions, will be apparent which are within the spirit and scope of the invention as defined in the appended claims.

What is claimed is:

1. A handleset with an adjustable latch retracting mechanism, which comprises:

a latchbolt movable between a latched position and an unlatched position for assembly with a door;

moving means attached to a portion of the latchbolt for facilitating movement of the latchbolt;

an operator mounted on the door for controlling movement of the latchbolt from a location externally of the door;

a rack coupled to the operator and movable upon movement of the operator;

a pinion in engagement with the rack and rotatable upon movement of the rack;

a half round spindle having one end attachable to the pinion and an opposite end engageable with the moving means where, upon operation of the operator, the rack is moved and the pinion and half round spindle are rotated to move the moving means and the latchbolt; and retracting means for allowing withdrawal of the half round spindle from engagement with the pinion to permit rotational movement of the spindle independently of the pinion to adjust the orientation of the spindle relative to the pinion.

2. The handleset as set forth in claim 1, which further comprises:

retaining means for holding the pinion in engagement with the rack when the half round spindle is withdrawn from engagement with the pinion.

3. The handleset as set forth in claim 1, which further comprises a lug formed on the pinion and a drive notch formed on the half round spindle and positionable about the lug and the retracting means includes means for mounting the half round spindle for relative movement of the drive notch from a position about the lug to decouple the spindle from the pinion.

4. The handleset as set forth in claim 1, which further comprises:

a pair of lugs formed on the pinion and displaced by a prescribed angular displacement from each other;

a drive notch formed in one end of the half round spindle;

the retracting means allowing for the separation of the spindle from the pinion to separate the drive notch from one of the pair of lugs;

means for facilitating repositioning of the spindle with the drive notch in alignment with the other of the pair of lugs; and means for urging the spindle toward the pinion to locate the drive notch about the other of the pair of lugs.

5. The handleset as set forth in claim 2, wherein the retaining means includes:

an insert mountable to the door;

a post extending from the insert, and means for attaching the spindle to the post for rotation relative to the post.

6. A handleset with an adjustable latch retracting mechanism, which comprises:

a support member attachable to a door;

a rack mounted for linear movement on and relative to the support member;

a pinion in engagement with the rack and rotatable upon movement of the rack;

at least two drive elements formed on the pinion and angularly spaced by a prescribed angular distance from each other;

a spindle;

at least one drive portion formed on the spindle and positionable selectively with either of the two drive elements of the pinion; and a cover attached to the support member to retain the rack, pinion and spindle in assembly.

7. The adjustable handleset as set forth in claim 6, which further comprises:

an opening formed through the cover; and a portion of the spindle extending outwardly from the cover and through the opening thereof to facilitate movement of the spindle away from the pinion so that the drive portion of the spindle can disengage one of the two drive elements and be positioned in engagement with the other of the two drive elements.

8. The handleset as set forth in claim 7, which further comprises:

a spring for biasing the spindle toward the pinion and allowing biased separation of the spindle from the pinion.

9. The handleset as set forth in claim 8, which further comprises:

a cylindrical member having an outwardly extending flange;

the cylindrical member being attached to the spindle; and the spring captured between the flange and the cover to urge the spindle toward the pinion.

10. The handleset, as set forth in claim 1, wherein the operator, rack and pinion are a first operator, a first rack and a first pinion, and which further comprises:

a second operator mounted on a side of the door opposite the side that the first operator is mounted;

a second rack coupled to the second operator and movable upon movement of the second operator;

a second pinion in engagement with the second rack and rotatable upon movement of the second rack; and the opposite end of the spindle extending from the moving means while maintaining engagement therewith and coupled to the second pinion where, upon operation of the second operator, the second rack is moved and the second pinion and half round spindle are rotated to move the moving means and the latchbolt.

11. The handleset as set forth in claim 10, which further comprises:

means for coupling the rotation of the pinion to the half round spindle; and means formed in the coupling means for accommodating adjustment of the spindle orientation relative to the first pinion.

12. A handleset with an adjustable latch retracting mechanism, which comprises:

a first support member attachable to a door;

a first rack mounted for linear movement on and relative to the support member;

a first pinion in engagement with the first rack and rotatable upon movement of the first rack;

at least two drive elements formed on the first pinion spaced by a prescribed distance from each other;

a spindle having at least one drive portion formed thereon and positionable selectively with either of the two drive elements of the first pinion;

a first cover attached to the first support member to retain the first rack, first pinion and portions of the spindle in assembly;

a second support member attachable to the door;

a second rack mounted for linear movement on and relative to the support member;

a second pinion in engagement with the second rack and rotatable upon movement of the second rack;

at least one drive element formed on the second pinion;

means for coupling the spindle to the one drive element of the second pinion;

a second cover attached to the second support member to retain the second rack, second pinion and coupling means in assembly; and the first cover and second cover each formed with openings to allow an extended portion of the spindle to extend therethrough and into engagement with the coupling means.

13. The handleset as set forth in claim 12, which further comprises:

a spring for urging the first spindle into engagement with the first pinion and contained between the first support member and the first cover.

14. The handleset as set forth in claim 12 wherein the coupling means includes:

a drive portion for engagement with the drive element of the second pinion; and an attachment facility for assembly with the extended portion of the spindle.

* * * * *